United States Patent [19]

Goldfarb et al.

[11] 4,078,800

[45] Mar. 14, 1978

[54] TOY ATHLETIC-TYPE PLAYING GAME

[76] Inventors: Adolph E. Goldfarb, 4614 Monarca Dr., Tarzana, Calif. 91356; Erwin Benkoe, 17965 Medley Dr., Encino, Calif. 91316

[21] Appl. No.: 770,187

[22] Filed: Feb. 18, 1977

[51] Int. Cl.[2] ..... A63F 7/06

[52] U.S. Cl. ..... 273/89; 46/119; 124/16

[58] Field of Search ..... 273/89, 90, 87.2, 87.4, 273/96 R, 129 HB; 124/16; 46/128, 142, 148, 119

[56] References Cited

U.S. PATENT DOCUMENTS

| | | | |
|---|---|---|---|
| 961,851 | 6/1910 | Fitzsimmons | 273/89 |
| 1,685,428 | 9/1928 | Lowry | 273/89 |
| 2,477,308 | 7/1949 | Malkan | 273/87.2 X |
| 2,506,190 | 5/1950 | Barnes | 46/128 X |
| 2,522,262 | 9/1950 | Geller | 273/89 |
| 3,190,653 | 6/1965 | Karthaus | 273/87.4 |
| 3,525,320 | 8/1970 | Dekan et al. | 124/16 |
| 3,862,513 | 1/1975 | Isaacson et al. | 273/89 X |

*Primary Examiner*—Anton O. Oechsle

*Attorney, Agent, or Firm*—Robert M. Ashen; Robert J. Schaap

[57] ABSTRACT

A toy playing game representative of an athletic game, as for example, baseball, and including a pair of player devices. A first of these player devices represents a baseball pitcher comprised of a structure capable of ejecting and propelling a ball toward the second of the player devices. The second of the player devices represents a baseball batter and is freely shifted with regard to the pitcher in order to locate an outwardly extending element, representative of a baseball bat, so it can be swung so as to hit the propelled ball. The batter device is comprised of an upstanding base section with a torso section pivotally mounted on the base section. The torso section carries the bat. The head section of the batter device is shiftably mounted for movement with respect to the torso section, so that upon depressing the head section, the torso section will pivot and thereby cause the pivotal or swinging movement of the bat. A camming arrangement may be used which multiplies the downward movement of the head section to provide greater swinging movement of the bat.

12 Claims, 8 Drawing Figures

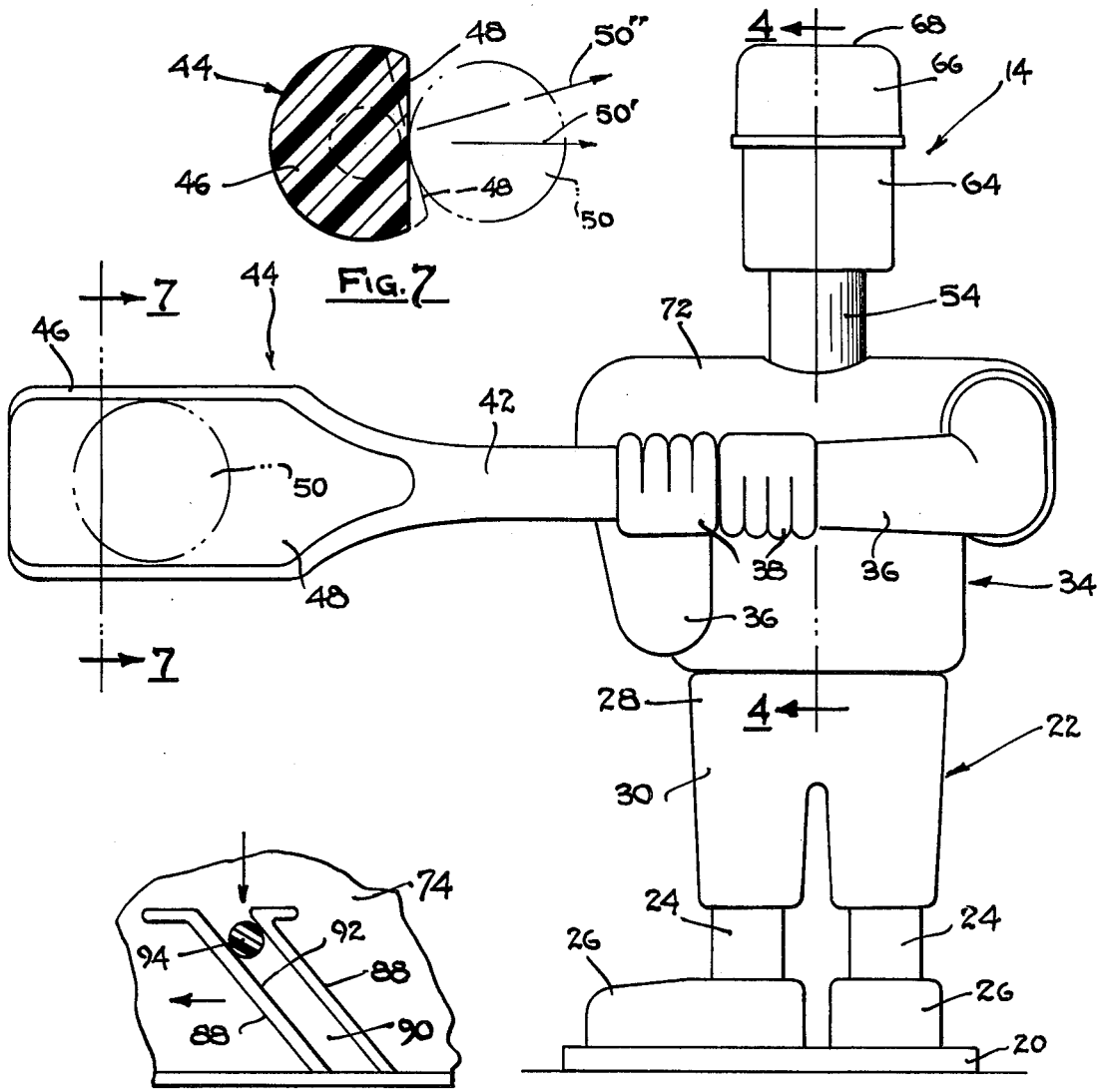
FIG. 7
FIG. 6
FIG. 2
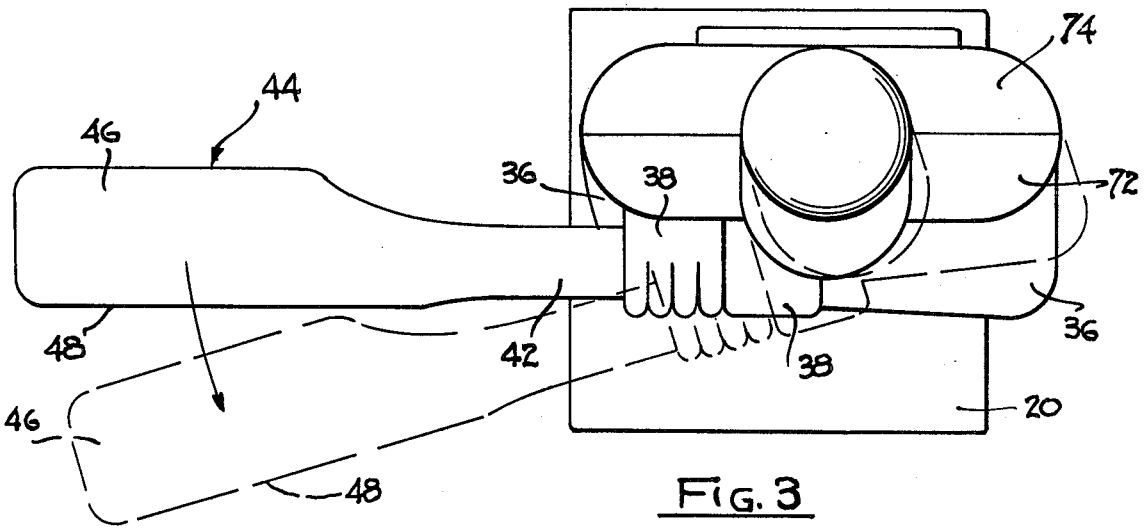
FIG. 3

TOY ATHLETIC-TYPE PLAYING GAME

BACKGROUND OF THE INVENTION

This invention relates in general to certain new and useful improvements in toy player devices capable of swinging at a playing ball and, more particularly, to toy playing games which utilize one or more of these toy player devices.

Small articulated playing devices representing human characters in athletic activities are used extensively in various toy games to simulate various athletic activities and provide play activity for children. Many of these playing devices have portions which are actuable by the child players in order to engage a playing piece, such as a playing ball.

One of the prior art games, which is representative of a simulated baseball game, and which utilizes such player devices relies upon a pedestal secured to a base plate for holding a playing ball. A player device, representative of a baseball batter, is also mounted on the plate in fixed relationship to the pedestal and can be actuated to cause an outwardly projecting element, representative of the bat, to engage the playing ball. In this form of game device, there is little, if any, competitive activity and little skill is required.

Some of these athletic player devices, representative of athletic characters, are energized by means of spring mechanisms, as for example, a simple spring wind-up mechanism. Thus, one such commercially available player device operates by rotating the upstanding player portion on a base member in order to create stored energy in a wind-up spring. The player can then rotate on the base plate upon release of a push-button actuating switch.

Other prior art game devices may also employ a pair of game player devices arranged to be operated by two players of the game in a more competitive nature. However, this form of playing game provides a game board in which the player devices are mounted on the game board for limited movement, as for example, a goalie tending a goal in a simulated hockey game. Again, in other forms of games which simulate, for example, tennis, the player devices are also movable, but only movable in limited and confined paths on the playing board.

These latter forms of game devices, while effective for their intended purpose, rely more on an element of chance and require less skill of the players of the game. In addition, these games are not very effective in teaching the players how to use manipulative skills.

The present invention obviates these and other problems in the provision of a pair of player devices each representative of an athletic baseball player. One of these player devices, representative of a baseball pitcher, is capable of propelling the playing ball toward the other of the player devices, representing a baseball batter. The player devices can each be operated by a different player of the game. The batter device may be freely moved about on a supporting surface and not within any limited or confined path or area. Thus, the batter device can be moved into a position so that an outwardly extending element, representative of a bat, can be swung to engage the playing ball. This second player device is uniquely designed so that the player of the game merely pushes downwardly on the head of the second player device to cause the bat to rotate in a generally horizontal arcuate path, and thereby engage the playing ball. In this way, the second player device does not require any stored energy for operation.

OBJECTS OF THE INVENTION

It is, therefore, a primary object of the present invention to provide a toy playing game, in a form representative of a baseball game, with a first player device capable of propelling a ball and a freely movable separate player device capable of being manually actuated and powered to swing a bat-like element for engaging the playing ball.

It is also an object of the present invention to provide a unique manually operable and powered player device capable of swinging an outwardly projecting element, as for example, the arm of a player characterization and a batting or ball-engaging implement, and which does not require stored sources of energy.

It is another salient object of the present invention to provide a player device of the type stated which is manually operable and powered by the user moving a part downwardly, and through a cam arrangement effecting the swinging movement in a generally horizontal arcuate path, and with the movement preferably being mechanically multiplied.

It is a further object of the present invention to provide a toy playing game and a player device of the type stated which are relatively durable in construction and which can be manufactured on a relatively economical basis.

With the above and other objects in view, our invention resides in the novel features of form, construction, arrangement and combination of parts presently described and pointed out in the claims.

BRIEF SUMMARY OF THE DISCLOSURE

A toy playing game simulating an athletic baseball game and involving a pair of player devices located on a supporting surface and which player devices are respectively representative of a baseball pitcher and a baseball batter.

The first of these player devices, in the form of a baseball pitcher, is comprised of a frame having a front "facade" plate thereof depicting the image of a baseball pitcher. This front plate is provided with a ball-ejection aperture and cooperates with a conventional ball-ejecting mechanism mounted on the frame. A movable arm in the ball ejecting mechanism ejects and propels a ball through the aperture toward the second of the player devices.

The second of the player devices, representative of an athletic baseball batter, is freely shiftable with respect to the baseball pitcher and comprises a base plate with an upstanding lower body section mounted thereon. This lower body section includes leg and pelvic portions which are integral and nonmovable with respect to the base plate. A torso section is pivotally mounted on the lower body section and carries therewith an outwardly projecting element in the form of a baseball bat. An upwardly projecting actuating rod extends upwardly from the torso section and carries a head section thereon. The head section is capable of being engaged and pushed downwardly in order to shift the actuating rod downwardly. As this occurs, the torso section will pivot with respect to the lower body section. A spring mechanism will bias the torso section to its original position upon releasing the head section. A camming mechanism causes the torso section to pivot relative to the lower body section and the head section upon pushing downwardly on the actuating rod.

The batter device of the present invention can be moved and then actuated by a player by merely pushing down on the head section. Thus, no form of stored energy is required. In addition, the camming mechanism is so designed so that a downward vertical force can be efficiently translated into a rotational force. Moreover, the amount of movement of the bat in a generally horizontal path is substantially greater than the amount of downward movement of the head section.

Inasmuch as the batter device of the present invention is not spring loaded and does not require other forms of stored energy for operation, the player of the game can regulate both the speed of movement and the degree of force imparted to the bat. Thus, the player can press down on the head of the batter device with varying degrees of force to control the force imparted to the swinging movement of the bat, or the player can press down more quickly or slowly to control the speed of movement of the bat.

BRIEF DESCRIPTION OF THE DRAWINGS

Having this described our invention in general terms, reference will be made to the accompanying drawings in which:

FIG. 2 is a front elevational view of one of the player devices, in the form of a baseball batter, and which forms a part of the playing game of the present invention;

FIG. 3 is a top plan view of the player device of FIG. 2;

FIG. 6 is a fragmentary vertical sectional view, taken along line 6—6 of FIG. 4;

FIG. 7 is a vertical sectional view, taken along line 7—7 of FIG. 2, and showing the cooperation of a playing ball with a playing bat of the baseball batter player device forming part of the present invention.

DETAILED DESCRIPTION OF THE PREFERRED EMBODIMENT

Figure 1:
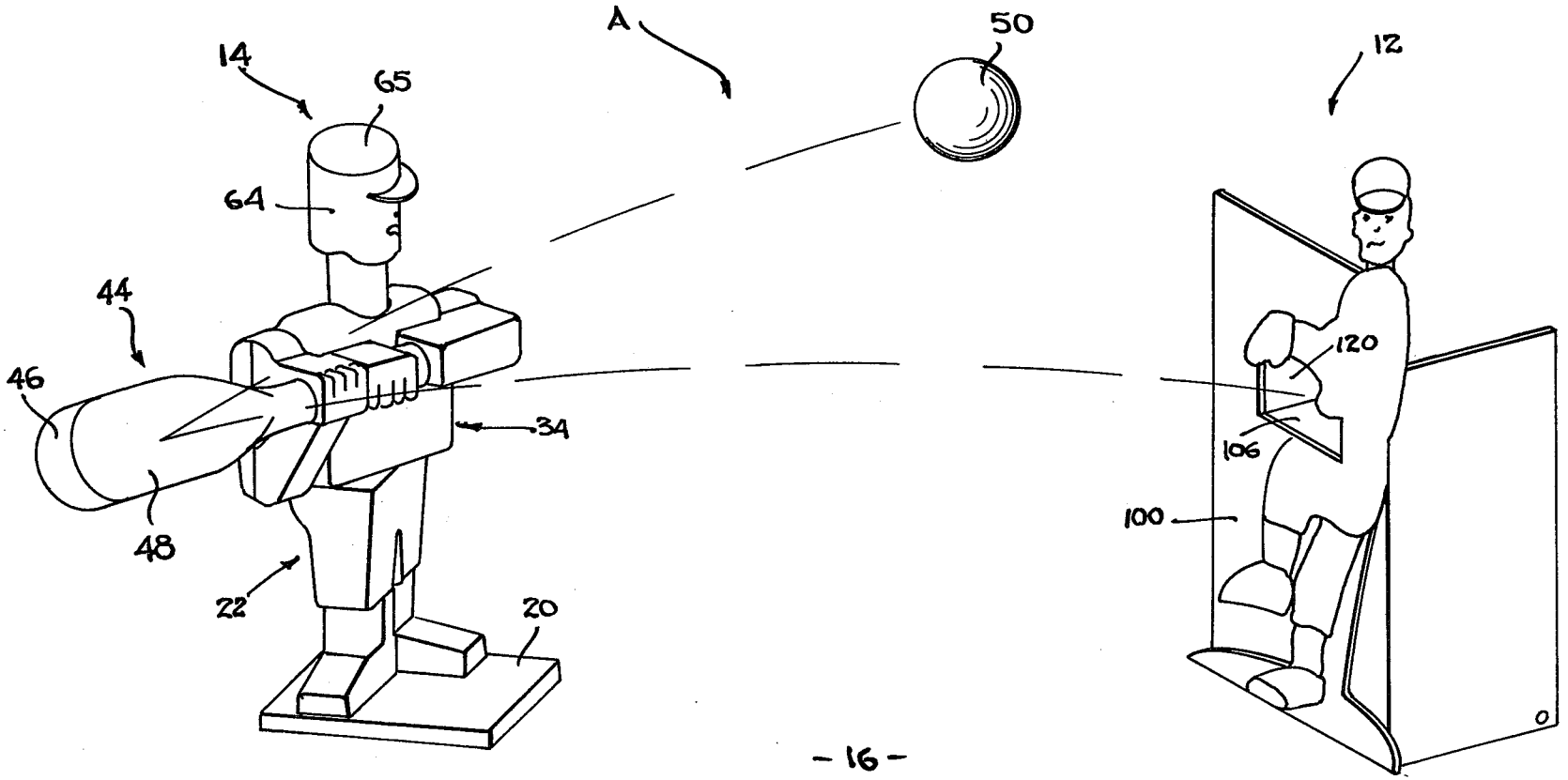
FIg. 1 is a perspective view of a pair of player devices forming part of the playing game of the present invention in playing position.

Referring now in more detail and by reference characters to the drawings which illustrate preferree embodiments of the present invention, A designates a toy playing game for simulating an athletic baseball game and comprises a first player device 12, in the form of a baseball pitcher, and a second player device 14, in the form of a baseball batter. The two player devices 12 and 14 are shown as being located on a relatively flat supporting surface 16.

The player device 14 comprises a base plate 20 with a lower body section 22 integrally formed with or otherwise rigidly secured to the base plate 20. This lower body section in the depicted characterization comprises a pair of legs 24 along with feet 26 and a pelvic regiion 28. By reference to FIG. 4, it can be observed that the lower body section 22, as well as other parts of the player device 14, are formed of two cooperating molded pieces designated as 30 and 32. The molded piece 30 comprises the front piece and the molded piece 32 comprises the rear piece and which are secured together by suitable means as hereinafter described. This form of fabricating the player device is preferred in terms of ease of fabrication and minimization of costs.

Rotatably mounted on the upper end of the lower body section 22 is a torso sectin 34, representative of the torso of an athletic baseball player. In the embodiment as illustrated, the torso section 34 includes a pair of integrally formed arms 36 and hands 38. The hands 38 are molded in such fashion that they are provided with a central aperture 40 in order to rotatably receive the shank 42 of an outwardly projectable ball engaging element forming part of the characterization of a baseball bat 44.

By reference to FIGS. 2 and 7, it can be observed that the outwardly projecting element 44 is provided with an enlarged ball engaging section 46 having a front, relatively flat ball engaging surface 48 which is preferrably at least the size of a playing ball, designated as 50. Moreover, it can be observed that the shank 42 of the baseball bat 44 is frictionally held but nevertheless rotatably located within the hands 38 of the player device 14 so as to be rotatable in order to adjust for the angle of the incoming playing ball 50 which is propelled by the other of the playing devices. Thus, when examining FIG. 7, it can be observed that the flat face 48 is located in a relatively vertical plane so as to engage the playing ball and propel the same in a relatively horizontal direction, designated by the arrow 50' in FIG. 7. In like manner, it can be observed that the shank 42 and hence the baseball bat 44 can be rotated so as to propel the playing ball 50 in an upwardly direct path as represented by the arrow 50'' in FIG. 7.

Figure 4:
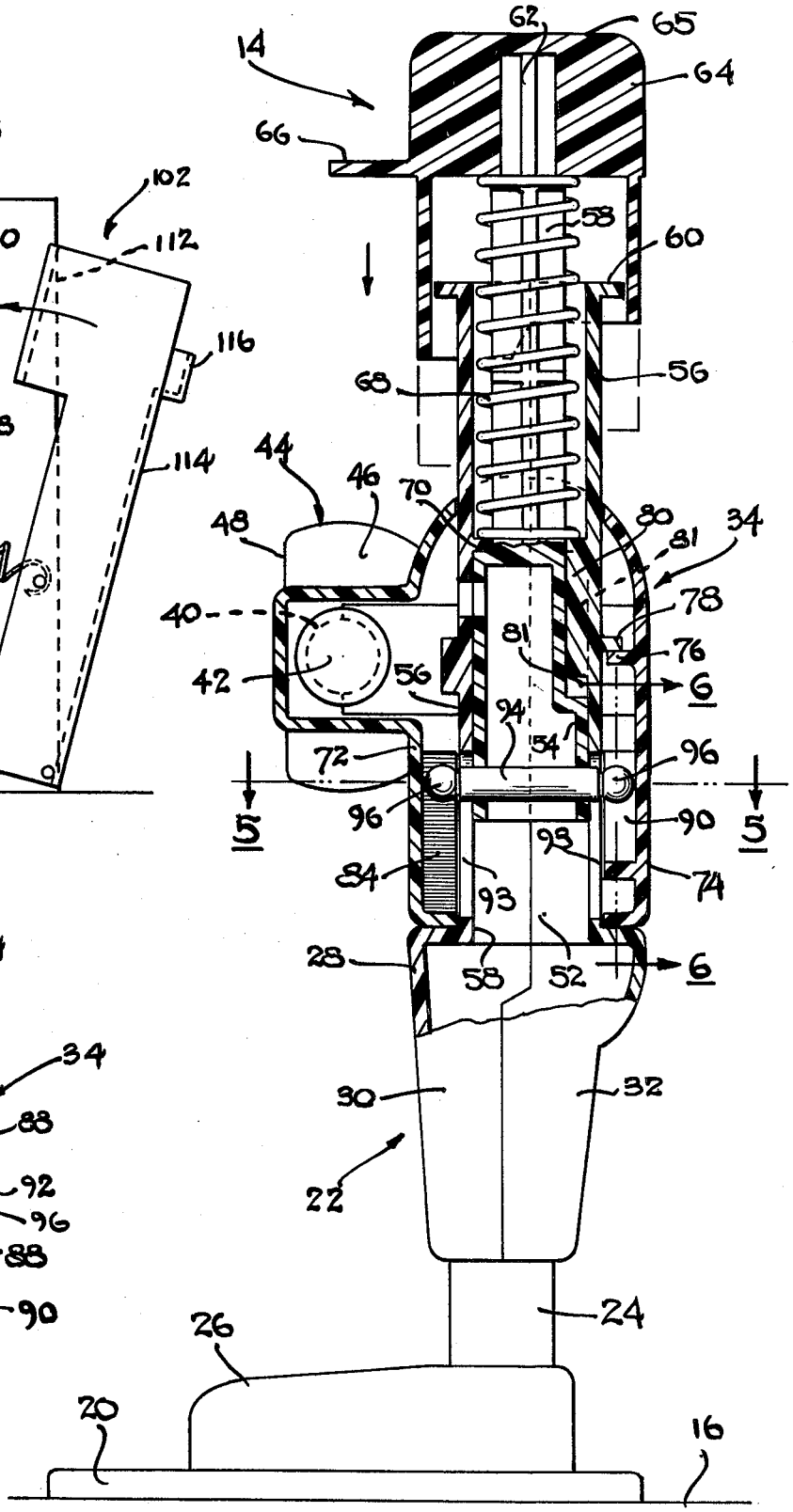
FIG. 4 is an enlarged vertical sectional view taken along line 4—4 of FIG. 2 and showing the interior operating mechanism and the mode of construction of the player device of FIG. 2.

The lower body section 22 includes an upwardly projecting cylindrically shaped tubular hub 52 which receives the lower end of an interiorly located upwardly projecting inner retaining sleeve 54 in the manner as illustrated in FIG. 4 of the drawings. Concentrically disposed around the inner sleeve 54 and the hub 52 is an elongated quill sleeve 56 which integrally merges into the inner sleeve 54 integrally merges at its upper end into a diametrically reduced upwardly extending actuating rod 58. The sleeve 54 is integrally provided with an outwardly flaring engagement flange 60 at its upper end. Moreover, the actuating rod 58 is provided with a diametrically reduced pin section 62 at its upper end for retaining a head section 64 including the representation of a baseball cap 66. The actuating rod 60 is concentrically provided with a compression spring 68 which bears against the head section 64 at its upper end and against a shoulder 70 formed on the inner sleeve 56, in the manner as illustrated in FIG. 4. In accordance with this construction, it can be observed that the outer sleeve 56 repesents the neck portion of the player device and the characterization as illustrated in FIG. 1 and in addition, serves as a guide for the actuating rod 58.

Disposed about the mis-section of the sleeve 56 is the outer torso section 34 comprised of a front shell 72 and a rear shell 74. These two shells 72 and 74 cooperate to form the torso section 34 and are secured together so as to rotate at a uniform torso section 34 with respect to lower body section 22 and the head section 64.

The rear shell 74 is provided with an inwardly projected flange 76 for engaging an outwardly projecting flange 78 on the sleeve 56 to prevent upward displacement of the torso 34. An inwardly extending guide tab 80 formed on the inner surface of the sleeve 56 in the manner as illustrated in FIG. 4 of the drawings is received in a vertical slot 81 provided in the lower portion of the actuating rod 54 to maintain the rod 54 in the same axial position when the head section 64 is engaged and pushed downwardly relative to the remainder of the player section 14. For this purpose, the head section 64 is provided with a flat upper surface 65 for engagement by a player of the game. In this way, it can be observed when the player of the game pushes downwardly on the top surfce 65, the actuating rod 58 and inner sleeve 54 will be pushed downwardly with respect to the outer sleeve 56, and against the action of the compression spring 68. However, upon release of the top wall 80, the head sectiion 64 will be biased upwardly by means of the compressed spring 68. Moreover, in the downward and upward movement, the inner sleeve 54 will maintain its same axial alignment with respect to the sleeve 56 by virtue of the vertical alignment provided by the guide tab 80 as illustrated in FIG. 4 of the drawings.

Figure 5:
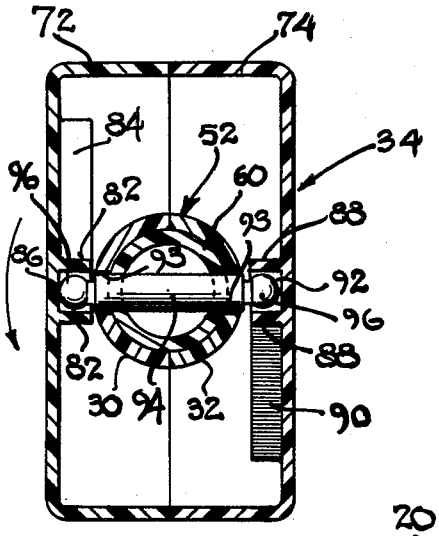
FIG. 5 is a horizontal sectional view, taken along line 5—5 of FIG. 4.

The torso section 34 is provided on its front shell 72 with a pair of somewhat downwardly and angularly located spaced apart flanges 82 forming a camming track 84, the lower surface of which provides a camming surface 86, in the manner as illustrated in FIGS. 4 and 5. In like manner, the rear shell 74 of the torso section 34 is similarly provided with a pair of downwardly and angularly and oppositely located and spaced apart flanges 88 which also form a camming track 90. Again, the lower surface 92 of the camming track 90 forms a camming surface, also in the manner as illustrated in FIGS. 4 and 5.

A camming pin 94 is retained by the lower end of the inner sleeve 54 and extends through slots 93 formed in the outer sleeve 56 in the manner as also illustrated in FIGS. 4 and 5. The camming pin 94 is similarly provided with a pair of cam-follower heads 96 on each of the opposite ends thereof and which ride within the camming tracks 84 and 90. More specifically, the cam-follower heads 96 ride against the camming surfaces 86 and 92 when the actuating rod 58 is pushed downwardly by pressing on the head section 64. The slots 93 enable vertical movement of the pin 94 without rotational movement thereof and which permits the torso to rotate relative to the lower body section. However, when the head section 64 is released, the spring 68 will bias the actuating rod 58 and the head section 64 upwardly, and, in which case, the camming heads 96 will ride against the uppermost of the flanges 82 and 88 which will thereupon serve as guide flanges.

In accordance with the above-outlined construction, it can be observed that as the actuating rod 58 is urged downwardly, the cam pin 94 is restrained to a linear movement by means of the slots 93 in the fixed outer sleeve 56. As the actuating rod 58 is pushed downwardly, the camming pin 94 through engagement with the oppositely oriented angled cam surfaces will cause the torso section 34 to rotate relative to the lower body section 22 and the head section 64. As indicated, this movement will also cause the rotative, or swinging movement of the outwardly extending element 44 so as to engage the playing ball. Upon release of the head section 64, the spring 68, which has been compressed, will bias the actuating rod 58, and hence the head section 64, upwardly. As this occurs, the camming heads 96 of the cam pin 94 will ride against the upper surfaces of the cam tracks, thereupon causing the torso section 34 to rotate to its initial position. In this way, it can be observed that the player of the device can freely movably shift the player device to the proper position in order to engage the playing ball. The player can also, and with the same hand, push down on the head section 64 in order to swing the outwardly extending element 44 and thereby engage the playing ball. In this way, no form of stored energy is required in the player device.

Figure 8:
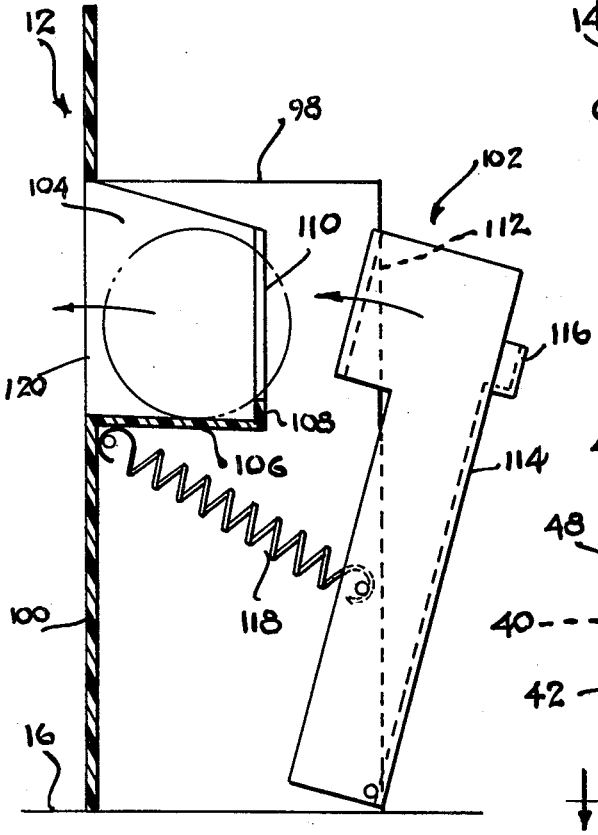
FIG. 8 is a vertical sectional view of the other of the player mechanisms forming part of the present invention.

The player device 12 is more fully illustrated in FIG. 8 of the drawings and comprises a frame structure 98 with a front plate 100 rigidly secured thereto. The front plate is formed with a peripheral shape and is suitably provided with a decal thereon in order to present the appearance of a baseball pitcher. The player device 12 also comprises a mechanism for storing and propelling a playing ball. These mechanisms for propelling playing balls are generally conventional in their construction and only one such mechanism is shown and described herein for purposes of understanding the present invention.

The frame structure 98 includes a ball propelling mechanism 102 having a ball receiving trough 104 formed by a slightly inclined downwardly bottom wall 106 and a back wall 108 with an aperture 110 thereon to receive the head 112 of a striker member 114. In this case, the striker member 114 is shown with a handle 116 for engagement by a player to be pulled rearwardly. Upon release of the striker member 114, a spring 118 secured to a leg of the striker member and to the frame structure 98 will pull the striker member 114 forwardly so that the head 112 engages the playing ball. For this purpose, the plate 100 is provided with an aperture 120 to permit the ball to be propelled therethrough.

It should be observed that other forms of ball propelling mechanisms could be employed in connection with the present invention. For example, a magazine could be included in the frame structure for retaining a number of playing balls. In like manner, other forms of mechanisms could be used for storing the playing balls as well as propelling the playing balls.

The playing balls are preferably of a size generally the same as a table tennis ball. In this respect, a conventional table tennis ball could be used. Nevetheless, any form of molded or other plastic formed ball could be used. Preferably, the ball is formed of a blow-molded, relatively unbreakable plastic material.

The various components forming part of either of the player devices can all be constructed of a number of well-known plastic materials including for example, polyethylene, polystyrene, polybutadiene, any of anumber of known vinylidene copolymers and the like. These components may be formed in any of a number of known plastic forming techniques including blow molding, injection molding, thermo-forming and the like. However, it can also be observed that many of the various components forming part of the player devices could be formed of other materials including light weight metals, such as aluminum or the like. Moreover, these various components can be formed of reinforced plastic materis as for example, resin matrix reinforced plastics including, e.g., thermosetting and thermoplastic resins along with various fiberous materials such as glass, boron, carbon or the like. The particular materials used in the construction of these components will be predicated upon necessary strength requirements and desired durability as well as manufacturing costs.

One of the unique aspects of the present invention is that the batter device 14 is freely movable on a supporting surface. In this respect, a suitable support surface for the playing game may be provided, although any form of support surface may be utilized. In accordance with the game, two players of the game can attempt to create a simulation of an actual baseball game. For this purpose, additional field devices may be provided. Nevertheless, the player actuating the pitcher device 12 will merely cause a playing ball 50 to be propelled toward the batter device 14. The player of the game moving the batter device 14 will attempt to shift the same into a proper position in order to engage the playing ball 50. This latter player will merely press down on the head section 64 to cause rotation of the torso section 34 and, hence, the bat 44 with respect to the playing ball. Moreover, this latter player will attempt to engage the playing ball with the flat surface 48 of the bat and propel the ball into a playing field area. In this way, there is a degree of skill in batting the playing ball to a field of play. The play of the game is not confined by a particular playing board space and the batter device is not confined to limited paths of movement.

Thus, there has been illustrated and described a unique and novel playing game which permits players to propel and return a player ball as well as a uniquely designed and operated batter device, and which therefore fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applicatiions which do not depart from the spirit and scope of the invention are deemed to be covered by the invention, which is limited only by the following claims.

Having thus described our invention, what we desire to claim and secure by Letters Patent is:

1. A movable toy game player device representative of an athletic game player capable of swinging toward and engaging a playing ball, said toy game player device comprising:

(a) base means, (b) an upstanding body section on said base means, (c) a torso section on said body section and being pivotal with respect to said body section about a generally upright axis, (d) a member extending outwardly from said torso section and being pivotal therewith along a generally horizontal path which is spaced upwardly from said base means to engage a playing ball, (e) a first camming element secured to said body section, (f) a second camming element secured to said torso section and cooperating with said first camming element to cause pivotal movement of said torso section with respect to said body section, (g) and actuable means operatively associated with said torso section and body section capable of being actuated and manually powered by generally downward manual pressure and movement to cause said pivotal movement of said torso section and said member with respect to said body section, said first camming element being a camming surface operatively associated with said torso section and said second camming element being a cam pin which rides along said camming surface when said actuatable means is actuated.

2. The movable toy game player device of claim 1 further characterized in that the pivota movement of said torso section is mechanically multiplied with respect to the downward movement of said actuable means.

3. The movable toy game player device of claim 1 further characterized in that said toy game player device has an exterior surface to represent a baseball player.

4. The movable toy game player device of claim 1 further characterized in that said game player device is freely movable on a supporting surface and cooperates with another device which is capable of propelling a playing ball to said first game player device.

5. The movable toy game player device of claim 1 further characterized in that said actuable means is a head portion of the player device and which is capable of being pushed downwardly to cause pivotal movement of the torso section.

6. A movable toy game player device representative of an athletic game player capable of swinging toward and engaging a playing ball, said toy game player device comprising:

(a) base means, (b) an upstanding body section on said base means, (c) a torso section on said body section and being pivotal with respect to said body section about a generally upright axis, (d) a member extending outwardly from said torso section and being pivotal therewith along a generally horizontal path which is spaced upwardly from said base means to engage a playing ball, (e) a first camming element secured to said body section, (f) a second camming element secured to said torso section and cooperating with said first camming selement to cause pivotal movement of said torso section with respect to said body section, (g) and actuable means operatively associated with said torso section and body section capable of being actuated and manually powered by generally downward manual pressure and movement to cause said pivotal movement of said torso section and said member with respect to said body section, said member being provided with a flat surface and being rotatable with respect to said torso section as to present the flat surface at varying angles with respect to said torso section.

7. A movable toy game player device representative of an athletic game player capable of swinging toward and to engage a playing ball, said toy game player device comprising:

(a) base means, (b) an upstanding body section on said base means, (c) a torso section on said body section and being rotational with respect to said body section about a generally upright axis, (d) a member extending outwardly from said torso section and being pivotal therewith through a generally horizontal arc spaced upwardly from said base means to engage a playing ball, (e) camming means operatively connected between said torso section and said body section and being operable to cause rotation of said torso section with respect to said body section when actuated, (f) a vertically shiftable actuating rod extending upwardly from said torso section and being operatively connected to said camming means, and (g) a head section carried by said actuating rod, for being engaged and depressed by downward pressure to urge said actuating rod downwardly to actuate said camming means and thereby cause rotation of said torso section with respect to said body section, said member being provided with a flat surface and being rotatable with respect to said torso section as to present the flat surface at varying angles with respect to said torso section.

8. The movable toy game player device of claim 7 further characterized in that spring means biases said actuating rod and head section upwardly when said head section is released.

9. The movable toy game player device of claim 7 further characterized in that said camming means comprises a first camming element operatively connected to said body section, and a second camming element operatively connected to said torso section and cooperating with said first camming element to cause rotation of said torso section with respect to said body section when actuated.

10. The movable toy game player device of claim 7 further characterized in that said toy game player device has an exterior surface to represent a baseball player.

11. The movable toy game player device of claim 7 further characterized in that said game player device is freely movable on a supporting surface and cooperates with another game player device which is freely movable on the supporting surface and which is capable of propelling a playing ball to said first named game player device.

12. The movable toy game player device of claim 7 further characterized in that the amount of movement of said member in the generally horizontal arc is large compared to the amount of downward movement of said head section and actuating rod.

* * * * *